US006735281B2

(12) United States Patent
Higgins et al.

(10) Patent No.: US 6,735,281 B2
(45) Date of Patent: May 11, 2004

(54) ROTATING ANODE FOR X-RAY TUBE USING INTERFERENCE FIT

(75) Inventors: Craig William Higgins, Blue Ash, OH (US); Gregory Alan Steinlage, Milwaukee, WI (US)

(73) Assignee: GE Medical Systems Global Technology, LLC, Waukesha, WI (US)

( * ) Notice: Subject to any disclaimer, the term of this patent is extended or adjusted under 35 U.S.C. 154(b) by 60 days.

(21) Appl. No.: 10/063,850

(22) Filed: May 17, 2002

(65) Prior Publication Data

US 2003/0215059 A1 Nov. 20, 2003

(51) Int. Cl.[7] ..... H01J 35/10
(52) U.S. Cl. ..... 378/132; 378/127; 378/128
(58) Field of Search ..... 378/121, 125, 378/127, 128, 132, 144

(56) References Cited

U.S. PATENT DOCUMENTS 4,063,124 A 12/1977 Appelt ..... 378/128
4,115,718 A * 9/1978 Eggelsmann ..... 378/128
4,635,283 A 1/1987 Starek et al. ..... 378/132
4,734,927 A * 3/1988 Leguen et al. ..... 378/200
4,866,748 A * 9/1989 Caraher et al. ..... 378/121
5,548,628 A 8/1996 Eggleston et al. ..... 378/125
5,838,762 A 11/1998 Ganin et al. ..... 378/125
6,002,745 A * 12/1999 Miller et al. ..... 378/128
6,125,169 A * 9/2000 Wandke et al. ..... 378/143
6,212,753 B1 4/2001 Derakhshan et al. ..... 29/447
6,445,770 B1 * 9/2002 Wandke et al. ..... 378/132
6,553,097 B2 * 4/2003 Hansen et al. ..... 378/144

* cited by examiner

*Primary Examiner*—Edward J. Glick
*Assistant Examiner*—Allen C Ho
(74) *Attorney, Agent, or Firm*—Cantor Colburn LLP

(57) ABSTRACT

A method for assembling a rotating X-ray tube, the X-ray tube having a cathode for emitting electrons, and a rotor and a bearing assembly for facilitating rotation of an anode. The method includes using an interference fit assembly between the bearing assembly and the rotor to provide a joint having balance retention. The using interference fit assembly further includes selecting a rotor hub of the rotor having a coefficient of thermal expansion which results in a composite coefficient of thermal expansion for the rotor assembly which closely matches that of a shaft of the bearing assembly. An interference fit joint between a shaft extending from a bearing assembly and a rotor hub is also disclosed, wherein the joint is completed without using any mechanical fasteners or metallurgical bonding, yet can carry all of the operational loads placed on the joint.

22 Claims, 4 Drawing Sheets

ROTATING ANODE FOR X-RAY TUBE USING INTERFERENCE FIT

BACKGROUND OF INVENTION

The present invention relates to rotating X-ray tubes and, more particularly, to rotating X-ray tubes which employ a rotating anode assembly having an interference fit with a bearing shaft.

X-rays are produced when, in a vacuum, electrons are released, accelerated and then abruptly stopped. This takes place in the x-ray tube. The filament in the tube is heated to incandescence (white heat) by passing an electric current through the filament and electrons are released from the filament. The electrons are accelerated by a high voltage (ranging from about ten thousand to hundreds of thousands of volts) between the anode (positive) and the cathode (negative) and impinge on the anode, whereby they are abruptly slowed down. The anode, which contains the electron impingement target, is often of the rotating disc type so that the electron beam is constantly striking a different point on the target perimeter. The x-ray tube itself includes a metal or glass frame which is stationary. Attaching to this frame is the cathode, the anode assembly including a rotating disk target, and a rotor that is part of a motor assembly that spins the target. A stator is provided outside the x-ray tube proximate to the rotor and overlapping therewith about two-thirds of the rotor length. The x-ray tube is enclosed in a protective casing having a window for the x-rays that are generated to escape the tube. The casing is filled with oil to absorb the heat produced by the x-ray generation process. The casing in some x-ray tubes may include an expansion vessel, such as a bellows. High voltages for operating the tube are supplied by a transformer. The alternating current is rectified by means of rectifier tubes (or "valves") in some cases by means of barrier-layered rectifiers.

X-ray tube performance can be affected by the balance of the anode assembly which includes the target, the bearing and the rotor. Specifically, during x-ray tube manufacturing, it is important to be able to balance the anode assembly and have it stay balanced during completion of the manufacturing cycle and during operation of the x-ray tube. As the size of x-ray tube targets has increased, it has proved difficult to maintain this balance and thus, reduced manufacturing yields and shortened operational lives have been experienced. Field evaluation of failed x-ray tubes has often indicated that the imbalance of the anode assembly has occurred in the region of attachment between the rotor and bearing.

State-of-the-art X-ray tubes utilize large cantilever mounted, targets rotating at speeds as high as 10,000 rpm. Extremely large temperature changes occur during the operation of the tube, ranging from room temperature to temperatures as high as 2500° C., produced by the deceleration of electrons in the tungsten-rhenium layer of the target track.

For the purposes of heat management and safeguarding of components such as bearings, materials with low thermal conductivity are placed in the heat path. In general, such materials have a much higher coefficient of thermal expansion than other materials used in an x-ray tube. However these components must be joined to the others in some fashion (i.e., welding, brazing, bolting, etc.). At these joints, the higher level of growth may cause yielding of the components which grow at a smaller rate.

Balance retention at high rotating speeds and high temperatures is extremely crucial. Typically, balance retention is driven by the shifting of the target and rotor relative to the bearing centerline during high temperature operation. As targets and rotors become larger and heavier, the amount of shift that will exceed the unbalance specification becomes less. Very small shifts can be troublesome. These small shifts can easily occur because of the large temperature changes, combined with the use of materials that have different coefficients of thermal expansion. The relative motion between parts which causes this shift typically occurs at the joints between the parts.

It would be desirable then to achieve improved joining for two or more members of an x-ray tube, particularly for high temperature applications, while maintaining excellent balance retention for a rotating anode of an x-ray tube. Furthermore, it would be desirable to simplify manufacturing through the elimination of mechanical fasteners, reduce design space, eliminate mechanical joint related stress concentrations, and eliminate high cost machining operations related to mechanical attachment features.

SUMMARY OF INVENTION

The above discussed and other drawbacks and deficiencies are overcome or alleviated by a method to join two or more components of an X-ray tube having similar thermal expansion rates, for high temperature applications. Use of this method involves an interference fit that affords balance retention and mechanical stability without any other form of mechanical attachment. In addition the method provides a compact design without a need for extensions or projections from the components to be joined.

In accordance with one aspect of the present disclosure, a method for assembling a rotating X-ray tube, the X-ray tube having a cathode for emitting electrons, and a rotor and a bearing assembly for facilitating rotation of an anode is disclosed. The method includes using an interference fit assembly between the bearing assembly and the rotor to provide a joint having balance retention. The interference fit assembly further includes selecting a rotor hub material that will allow the thermal expansion characteristics of the rotor to be matched with those of the bearing. The shaft and aperture in said rotor hub are configured to interference fit tolerances and then joined providing a joint having balance retention.

In another aspect of the present disclosure, an interference fit joint between a shaft extending from a bearing assembly and a rotor hub is also disclosed, wherein the joint is completed without using any mechanical fasteners or metallurgical bonding, other than diffusion bonding which is expected to occur, but is not required for proper functioning of the completed joint attachment.

The above discussed and other features and advantages of the present invention will be appreciated and understood by those skilled in the art from the following detailed description and drawings.

BRIEF DESCRIPTION OF DRAWINGS

Referring to the exemplary drawings wherein like elements are numbered alike in the several Figures.

DETAILED DESCRIPTION

In a typical X-ray tube assembly, the target, rotor assembly, and bearing assembly, for example, are assembled using bolted, brazed and/or welded joints. The present disclosure provides for a significant improvement in the fit between joined members of the X-ray tube, particularly with a bearing shaft assembly and rotor assembly having similar thermal expansion rates. Furthermore, the purpose of this invention is to improve the balance retention during tube life.

Figure 1:
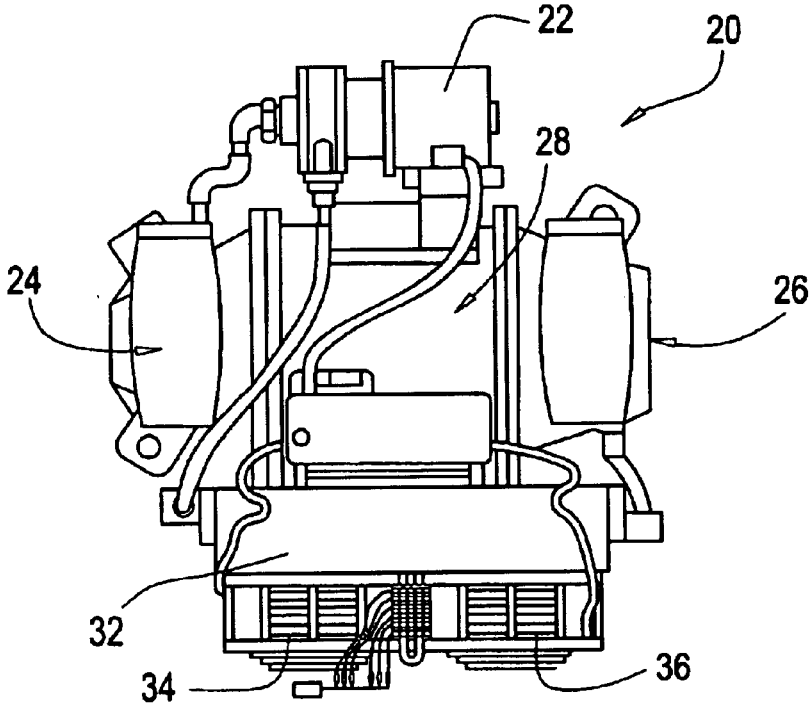
FIG. 1 PRIOR ART
FIG. 1 is a plan view of a representative x-ray system.
Figure 2:
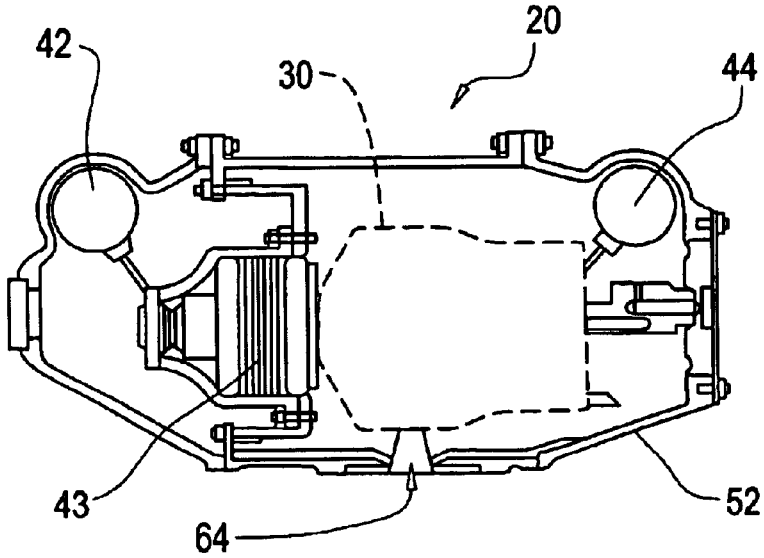
FIG. 2 PRIOR ART
FIG. 2 is a sectional view with parts removed of the x-ray system of FIG. 1.
Figure 3:
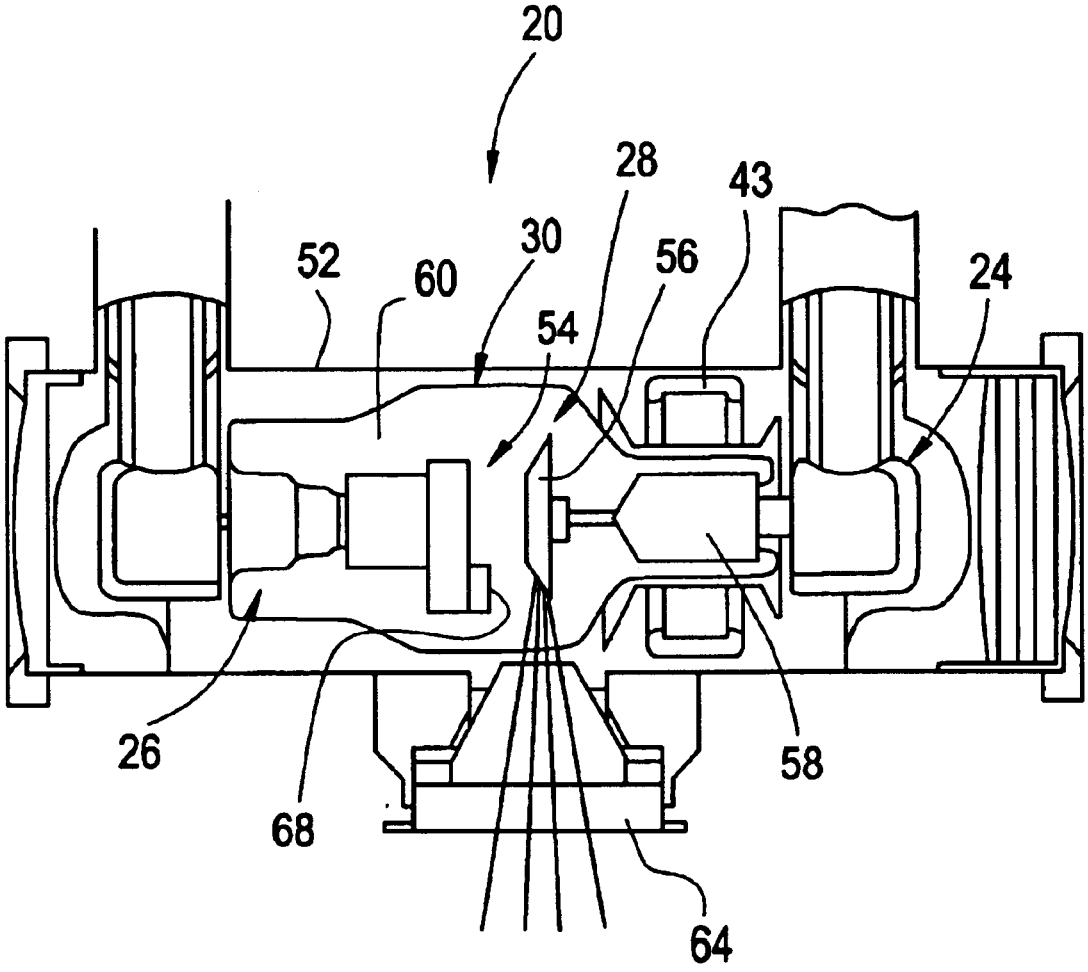
FIG. 3 PRIOR ART
FIG. 3 is a schematic representation of another representative x-ray system having an x-ray tube positioned therein.

A representative x-ray system with which an embodiment of the present disclosure could be used is illustrated as generally designated by the numeral 20 in FIGS. 1, 2, and 3. As can be seen, the system 20 comprises an oil pump 22, an anode end 24, a cathode end 26, a center section 28 positioned between the anode end and the cathode end, which contains the x-ray tube 30. A radiator 32 for cooling the oil is positioned to one side of the center section and may have fans 34, 36 operatively connected to the radiator 32 for providing cooling air flow over the radiator as the hot oil circulates therethrough. The oil pump 22 is provided for circulating the hot oil through the system 20 and through the radiator 32, etc. As shown in FIG. 2, electrical connections are provided in the anode receptacle 42 and the cathode receptacle 44.

As shown in FIG. 3, the x-ray system 20 comprises a casing 52, preferably made of aluminum and lined with lead, a cathode plate 54, a rotating target 56 and a rotor 58 enclosed in a glass or metal envelope 60. A stator 43 is positioned outside the glass envelope 60 inside the lead lined casing 52 relative to the rotor 58. The casing 52 is filled with oil for cooling and high voltage insulation purposes as was explained above. A window 64 for emitting x-rays is operatively formed in the casing 52 and relative to the target 56 for allowing generated x-rays to exit the x-ray system 20.

Figure 4:
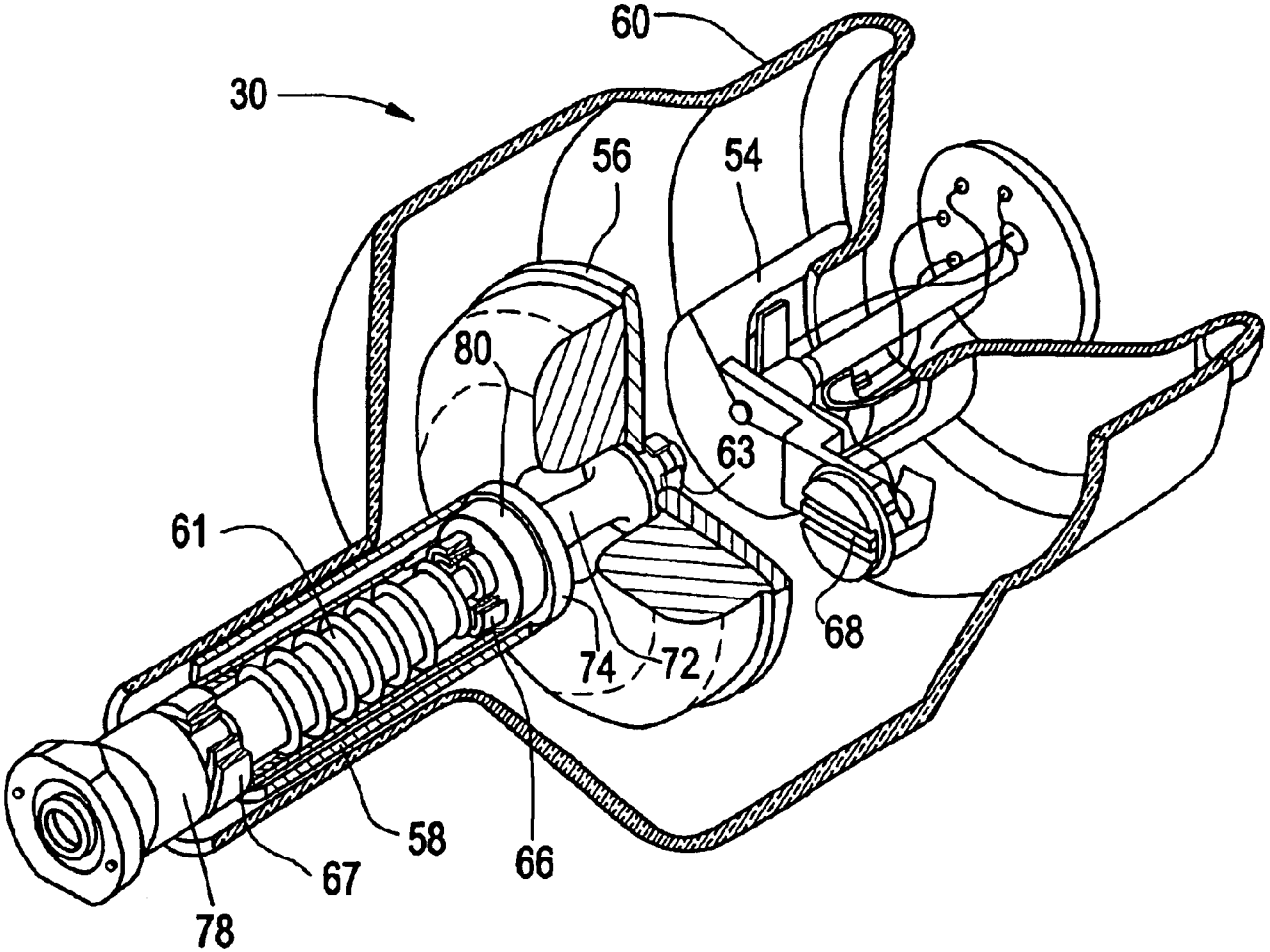
FIG. 4 PRIOR ART
FIG. 4 is a partial perspective view of a representative x-ray tube with parts removed, parts in section, and parts broken away.

Referring to FIG. 4, there is shown the cathode 54 positioned inside the glass or metal envelope 60. As is well known, inside the glass or metal envelope there is a vacuum of about $10^{-5}$ to about $10^{-9}$ torr. Electrons are generated at the cathode filament 68 and aimed at the target 56. The target is conventionally connected to a rotating shaft 61 at one end by a Belleville nut 63. A front bearing 66 and a rear bearing 67 are operatively positioned on the shaft 61 and are held in position in a conventional manner. The bearings 66 and 67 are usually solid-film lubricated and therefore have a limited operational temperature range.

A preload spring 70 is positioned about the shaft 61 between the bearings 66, 67 for maintaining load on the bearings during expansion and contraction of the anode assembly. A target stud 72 is utilized to connect the target 56 to the bearing shaft 61 and rotor hub 74. The rotor hub 74 interconnects the target 56 and rotor 58. The rotor 58 drives the rotation of the anode assembly. The bearings, both front 66 and rear 67, are held in place by bearing retainers 78 and 80.

The temperature in the area of the filament 68 can get as high as about 2500° C. Other temperatures include about 1100° C. near the center of the rotating target 56, which rotates at about 10,000 rpm. Temperatures of the focal spot on the target 56 can approximate 2500° C. and temperatures on the outside edge of the rotating target 56 approach about 1300° C. The temperature in the area of the rotor hub 74 approaches 700° C. and of the front bearing approaches 450° C. maximum. Obviously, as one moves from the target 56 to the rotor 58 and stator 43, the temperature decreases.

During operation of some x-ray systems having larger diameter targets, severe protocol users have maximized usage of the system by making as many scans at high peak power in as short a time as possible. One of the problems with utilizing any x-ray system in this continuous type of operation is the amount of heat that is generated, which may in fact destroy the bearings 66, 67, especially the front bearing 66.

If the x-ray tube target 56 and rotor 58 were allowed to continue to rotate at 10,000 rpm between scans, the bearings would wear out prematurely and cause the tube to fail. Thus, if it appears that there would to be more than some specific time delay between scans, the x-ray system operating control system software is programmed to brake the rotor by rapidly slowing it completely down to zero (0) rpm. However, when ready to initiate a scan, the control system software is programmed to return the target and the rotor to 10,000 rpm as quickly as possible. These rapid accelerations and brakes are utilized because, among other reasons, there are a number of resonant frequencies that must be avoided during the acceleration from zero (0) to 10,000 rpm and the brake from 10,000 rpm to zero (0) rpm. In order to pass through these resonant frequencies both immediately before a scan or a series of scans and after a scan or series of scans as fast as possible, the x-ray system applies maximum power to bring the target, or anode assembly, to 10,000 rpm or down to zero (0) rpm in the least amount of time possible.

It should be noted that the x-ray tube target and rotor can be accelerated to 10,000 rpm from a dead stop in about 12 to about 15 seconds and slowed down at about the same rate. Vibration from the resonant frequencies is a problem if the tube is allowed to spin to a stop without braking. This vibration is also a problem if the anode of the tube exhibits poor balance retention.

It has been found that during these rapid accelerations to 10,000 rpm and the immediate braking from 10,000 rpm to zero, stresses, mechanical as well as thermal, impact on the rotor 58, target and bearing connections. These stresses may contribute to anode assembly imbalance which is believed to be the leading cause of recent x-ray tube failures. It has been determined that these imbalance problems are most likely caused by changes that occur in the areas where the target stud 72 and rotor 58 are attached to the bearing shaft.

Figure 5:
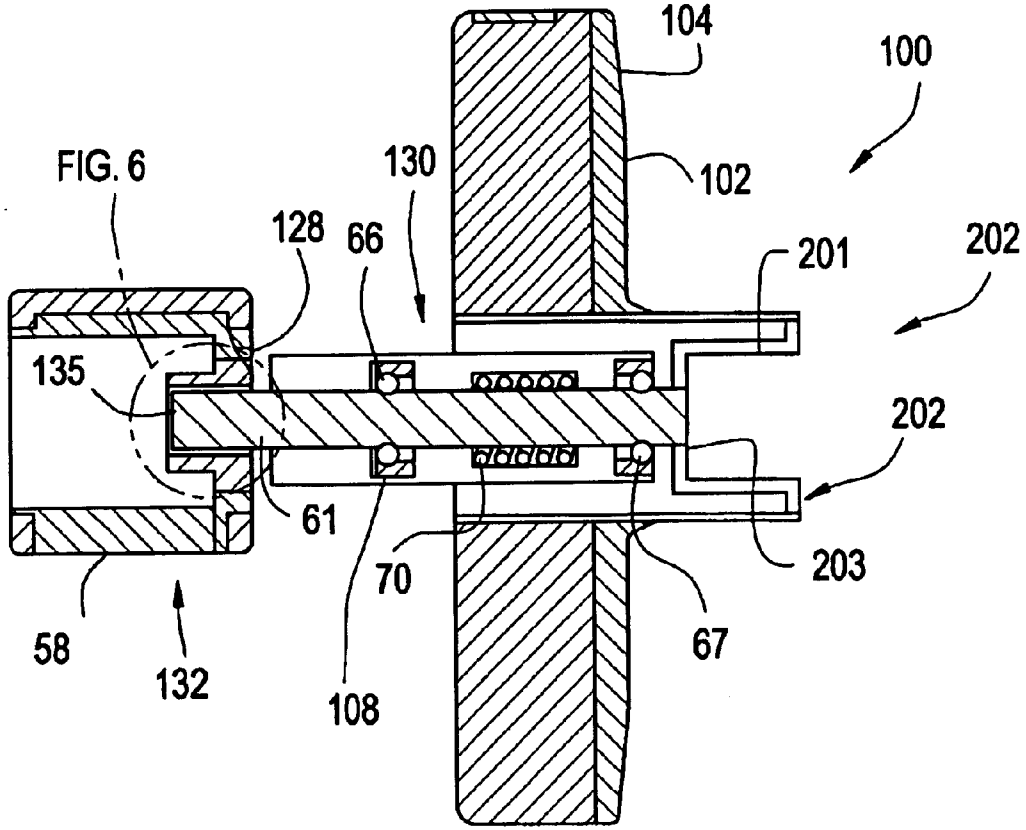
FIG. 5 is a partial sectional view of one exemplary embodiment of an x-ray tube rotor hub/shaft connection of the present disclosure.

Referring now to FIG. 5, therein is shown a representative anode assembly with a rotor/bearing shaft joint embodying the present disclosure, in one preferred form thereof, generally designated by the reference numeral 100. The anode assembly 100 comprises the target 102, preferably made of molybdenum alloy TZM, and, a focal track 104, preferably made of a tungsten-rhenium alloy, operatively connected to the target 102 by conventional metallurgical means for generating the x-rays in a position so they will pass through the window 64 (as shown in FIG. 3). The target assembly is a powder-metallurgy-alloy preferably compatible with all processes used for target manufacture including: powder making, die pressing, sintering, forging, annealing, and coating or brazing to a graphite back. The target is attached to the bearing shaft by means of a thermal barrier 201. The target is affixed to the thermal barrier 201 by means of a bolted joint generally proximate area at 202. The thermal barrier 201 is affixed to the bearing shaft by means of a weld 203.

Concerning the attachment of the target/thermal barrier/bearing shaft assembly to the rotor body assembly, shaft 61 extends from bearing 66 disposed in tubular stem 108. Shaft 61 then attaches to the rotor 58 via a rotor hub 128 to form the anode assembly.

As illustrated in FIG. 5, in one embodiment, hub 128, preferably made of INCOLOY (IN)909 or other suitable nickel-cobalt-iron alloy with high strength and a stable, or constant, coefficient of thermal expansion and constant modulus of elasticity is preferably EB welded within the rotor 58. The rotor 58 is preferably made from copper bars cast onto a steel carrier. This structure commonly has a coefficient of thermal expansion (CTE) far in excess of the bearing shaft 61. Rotor hub 128 is preferably configured to receive shaft 61 such that the composite coefficient of thermal expansion (CTE) for rotor 58/hub 128 assembly closely matches that of shaft 61. The shaft 61 may also be made of materials such as CTX Rex 20 or other suitable hard steel.

Figure 6:
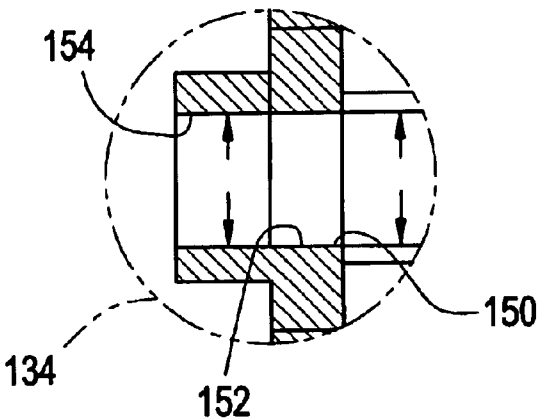
FIG. 6 is an enlarged sectional view of the rotor hub of FIG. 5.

Continuing with FIG. 5 and referring also to FIG. 6, the present disclosure proposes using interference fit assembly in the X-ray tube anode assembly, to eliminate shifting of the rotor 58 relative to the bearing shaft 61 and to eliminate other means of mechanical attachments necessary to carry the driving torque such as bolted joints, pins, brazes, welds, keys or splines, for example. The concept of interference fit assembly is particularly adaptable for use with the anode assembly 100. The anode assembly 100, is comprised of three main members, including the target 102, the bearing assembly 130, and the rotor assembly 132. Furthermore, anode assembly 100 comprises a main joint, i.e., a bearing shaft-to-rotor joint at location 134. Application of interference fit assembly at the bearing shaft-to-rotor joint at location 134, in accordance with the present disclosure, ensures balance retention during the life of the tube by eliminating any shifts in this main joint. In a preferred embodiment of the present invention, then, a joint end of shaft 61 of bearing assembly 130 and hub 128 of rotor assembly 132 are machined to very tight tolerances to achieve a high level of control over the diametric interference between matching surfaces. The interference fit parts can then be assembled using any suitable means such as radio-frequency (RF) heating.

By way of example only, and not to be considered as limiting the scope of the invention, interference fit assembly of an anode structure is described. Still referring to FIGS. 5 and 6, joint at location 134 is subjected to an assembly step, such as RF heating. This allows for joint end 135 of shaft 61 extending from bearing assembly 130 to be received into a receiving aperture 136 of hub 128. When the bearing assembly 130 is positioned, the application of heat stops and the joint at location 134 is allowed to cool. This results in an anode assembly 100 having ensured balance retention during the life of the tube by eliminating even the minutest shifts in this bearing shaft-to-rotor joint.

Shrink fitting connections, such as those between axial projection of shaft 61 and rotor hub 128, may be accomplished by processes which are known to the prior art. In the selection of materials and dimensions, such as for anode assembly 100, rotor hub 128 is, for example, heated to about 400° C., and joint end 135 of shaft, which is conveniently at room temperature, is slidably received therein. Subsequently, the resulting assembly is cooled to room temperature. In the subsequent heating of this assembly as incorporated into an x-ray tube during operation of the anode assembly 100, the heating always proceeds from the anode target 102 as a consequence of the heat flow through axial bearing shaft 61, and from shaft 61 into rotor hub 128 to rotor assembly 132. The shrink-fitting operations are thus accomplished and arranged so that permanent, tight connections are obtained through shrink-fitting which take account of the manner in which heating proceeds.

By way of variation, a shrink-fitting may also proceed in such a manner that the axial projection of shaft 61 is first cooled to a great extent and then inserted into the aperture of the (room temperature) rotor hub 128. During subsequent heating to room temperature, the desired fastening proceeds as a result of the expansion of the projection of shaft 61. In order to effect cooling, a liquified gas, such as liquid air or liquid nitrogen, can be used. This method has been proven to be especially favorable, and is simple, because it is possible to proceed with a mere dipping of the entire rotor assembly 132 into the liquid gas followed by such a subsequent insertion. A combination of both processes (heating of the rotor hub 128 and cooling of the projection of shaft 61) can also render possible a simplification and simultaneous adaptation of the invention to the materials employed.

It will be understood by one skilled in the pertinent art that an exemplary embodiment discloses a high composite CTE rotor system that is joined to a much lower CTE bearing shaft system by means of a hub in the rotor system that has a CTE much lower than that of the rotor or the bearing shaft. This causes the effective or composite CTE of the rotor to match that of the bearing shaft. The resulting joint is used to carry the torque of the rotor, which is generated to rotate the target, without the necessity for any other means of mechanical attachment (i.e., bolt, braze, weld, spline, key, and the like). Moreover, depending upon the selection of construction materials, a type of pressure welding between contacting components is commonly obtained during shrink-fitting as a result of the pressures and temperatures inherently occurring. The axial projection of the shaft and the rotor hub are thereby so securely interconnected to one another that they can no longer be separated from one another during a subsequent heating. A tight connection of this type occurs, for example when employing as a hub material INCOLOY, and as a shaft material, such as tool steel.

As also illustrated in FIGS. 6, aperture 136 of hub 128 is chamfered at an opening edge 150 to facilitate axial installation of shaft 61. Following the chamfer, aperture 136 is further defined by a first inner cylinder wall 152 that extends to a second inner cylinder wall 154 defining aperture 136 in hub 128. First inner cylinder wall 152 prevents axial and circumferential movement of rotor assembly 132 relative to shaft 61 when first inner wall 152 is shrink fitted around shaft 61. In sum, the configuration of hub 128 provides for a unitary construction fit between bearing shaft assembly 130 and the rotor body assembly 132, which is more resistant to structural changes during the stressing caused by the above mentioned severe protocol uses. Since it has been determined that the anode assembly 100 imbalance problems are often caused by changes that occur in the area of the rotor/bearing shaft assembly attachment, the illustrated construction is believed to at least reduce the relative changes in position between the stem and target and rotor thereby significantly reducing anode assembly imbalance failures.

Although the invention has been described relative to interference fit assembly of an anode structure, it will be obvious to those skilled in the art that concept of the present invention, interference fit assembly in the X-ray tube environment, is applicable to all aspects of X-ray tube assembly. It will further be obvious to those skilled in the art that various modifications and variations of the present invention are possible without departing from the scope of the invention, which applies interference fit assembly in the X-ray tube environment to prevent tube components from shifting during tube life. For example, the heating of the components of the joints and the mechanical assembly process could be performed in any of a variety of suitable ways, including changing the actual order of assembly, without departing from the scope of the invention.

The use of a rotor hub having a matched coefficient of thermal expansion which causes the composite coefficient of thermal expansion of the rotor assembly to closely match that of the bearing shaft allows shrink fit attachment of a rotor assembly to the bearing shaft assembly without the requirement to use mechanical fasteners or other additional joining techniques (e.g., welding, soldering, brazing, etc.). The above-described method does not require tubular attachments or extensions as in the prior art and the joint is formed with materials selected to match coefficients of thermal expansion enabling operational loads to be carried by the shrink fit attachment, without using additional mechanical or metallurgical bonding means between the rotor and bearing shaft assemblies. In this manner, increased balance retention and reduced design space results, while mechanical related stress concentrations, high cost machining operations associated with mechanical attachment are eliminated.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A method for assembling a rotating X-ray tube, the X-ray tube having a cathode for emitting electrons, and a rotor and a bearing assembly for facilitating rotation of an anode, the method comprising:

using interference fit assembly between the bearing assembly and the rotor to provide a joint having balance retention;

wherein the using interference fit assembly further includes:

selecting a shaft of the bearing assembly;

selecting a rotor hub of said rotor having a coefficient of thermal expansion which matches a higher coefficient of thermal expansion of the rotor to a lower coefficient of thermal expansion of said shaft;

configuring said shaft and an aperture in said rotor hub to interference fit tolerances; and joining said shaft to said rotor hub providing said joint having balance retention.

2. The method in claim 1, wherein said joining said shaft to said rotor rub includes heating said rotor hub to facilitate positioning of components of the X-ray tube.

3. The method in claim 1, wherein said joining said shaft to said rotor rub includes cooling said shaft to facilitate positioning of components of the X-ray tube.

4. The method of claim 1, wherein said joining is completed using means for shrink fit, said means for shrink fit is configured for carrying operational loads on the joint without a need for mechanical or metallurgical fasteners.

5. An anode assembly for an x-ray tube comprising:

a rotor body assembly including a rotor and a stator, the stator being operatively positioned relative to the rotor body assembly;

a target, operatively positioned relative to the cathode assembly, operatively connected to a bearing by a thermal barrier; and means, including a rotor hub operatively positioned within the rotor, coaxially aligned with a shaft extending from the bearing assembly, for operatively connecting the shaft of the bearing assembly to the rotor hub of the rotor body assembly, the rotor hub having a coefficient of thermal expansion which matches a higher coefficient of thermal expansion of the rotor to a lower coefficient of thermal expansion of the shaft.

6. The anode assembly of claim 5, wherein said means includes fastening without using mechanical fasteners or metallurgical bonding.

7. The anode assembly of claim 5, wherein a thin-walled tubular stem tubular stem operatively supports said shaft between two center loaded bearings, each bearing disposed at opposite ends of the tubular stem.

8. The anode assembly of claim 5, wherein the rotor hub is comprised of a nickel-cobalt-iron alloy.

9. An x-ray system comprising;

an enclosure;

at least one cooling means, operatively connected to the enclosure, for cooling the system;

an x-ray tube, operatively positioned inside the enclosure, for directing x-rays toward a target, the x-ray tube comprising:

an envelope;

a cathode, operatively positioned in the envelope;

an anode assembly including:

a rotor body assembly including a rotor and a stator, the stator being operatively positioned relative to the rotor body assembly;

a target, operatively positioned relative to the cathode assembly, operatively connected to a bearing shaft by means of a thin-walled tubular thermal barrier; and a target/bearing assembly to the rotor body assembly connection structure, operatively positioned for operatively connecting the target/bearing assembly to the rotor body assembly, wherein the target/bearing assembly to the rotor body assembly connection structure further comprises, including shrink fit means, operatively positioned between the target/bearing assembly and the rotor body assembly, for operatively connecting the target/bearing assembly to the rotor body assembly, the shrink fit means having a coefficient of thermal expansion which matches a higher coefficient of thermal expansion of the rotor body assembly to a lower coefficient of thermal expansion of the target/bearing assembly.

10. The x-ray system of claim 9, wherein the target/bearing assembly to the rotor body assembly connection structure further comprises:

a shaft operatively positioned between the large bore, thin-walled tubular thermal barrier and operatively supported by opposing bearings mounted with a thin-walled tubular stem; and a rotor hub operatively positioned in the rotor body assembly, the rotor hub having an aperture configured to receive said shaft and form an interference/shrink fit engagement.

11. The x-ray system of claim 10, wherein the rotor hub material is selected to match coefficients of thermal expansion between the bearing shaft and the rotor body assembly enabling operational loads to be carried by the shrink fit without any other means.

12. The x-ray tube of claim 10, wherein the rotor hub comprises a nickel-cobalt-iron alloy.

13. An anode assembly for an x-ray tube comprising:

a rotor body assembly including a rotor and a stator, the stator being operatively positioned relative to the rotor body assembly; and a target, operatively positioned relative to a cathode assembly, operatively connected to a thin-walled tubular thermal barrier to form a target/bearing assembly, and a target/bearing assembly to the rotor body assembly connection structure, operatively positioned between the target/bearing assembly and the rotor body assembly, for operatively connecting the target/bearing assembly to the rotor body assembly, wherein the target/bearing assembly to the rotor body assembly connection structure further comprises:

a shaft operatively positioned between the large bore, thin-walled tubular thermal barrier and operatively supported by opposing bearings mounted with a thin-walled tubular stem; and a rotor hub operatively positioned in the rotor body assembly, the rotor hub having an aperture configured to receive said shaft and form an interference/shrink fit engagement, wherein the material for the rotor hub is selected to match coefficients of thermal expansion between the rotor body assembly and the bearing shaft enabling operational loads to be carried by the shrink fit without any other means.

14. The anode assembly of claim 13, wherein the material selected for the rotor hub is selected to match a higher coefficient of thermal expansion of the rotor with a lower coefficient of thermal expansion of the shaft.

15. A rotating anode assembly for an X-ray tube such rotating anode assembly being one of the type which includes an anode target and a cylindrical rotor means therefore, such rotor means having (a) an axis, (b) means responsive to circumferentially applied electromagnetic force causing said rotor means to rotate about such axis, and (c) bearing means functionally associated therewith and adapting said rotor means for rotational movements relative to said bearing means, said bearing means including contact portions for applying during such rotational movements an electron accelerating potential to said target comprises:

a shaft axially extending from one end of said bearing means and terminating forwardly in an axial projection configuration, said shaft being rotationally associated with said rotor means and rotatable therewith, said target having a generally disc-shaped body and being coaxial with said axis, said target having radially tapered surface portions on one face thereof adjacent the circumferential periphery of said target, said surface portions being adapted to convert incident electron energy striking same in an axially parallel direction into X-ray energy emitted therefrom at a predetermined angle relative to said incident electron energy, and further having an axial projection extending from the opposed face thereof, said axial projection being shrink fitted with a coaxially located rotor hub disposed within said rotor means, said rotor hub having a coefficient of thermal expansion which matches a higher coefficient of thermal expansion of said rotor means to a lower coefficient of thermal expansion of said axial projection.

16. The anode assembly of claim 15, wherein at room temperature said rotor hub has an aperture configured to receive said axial projection, said aperture is cylindrical having a diameter smaller than an outside diameter of said axial projection.

17. The anode assembly of claim 16, wherein at room temperature said aperture of said hub is defined by an entry chamfer extending to a first inner cylinder wall that further extends to a second inner cylinder wall, wherein said first inner cylinder wall has a diameter smaller than said second inner cylinder wall.

18. The anode assembly of claim 15 wherein said rotor hub is comprised of a metal selected to cause a composite coefficient of thermal expansion of the rotor match that of said axial projection.

19. The anode assembly of claim 15 wherein said rotor hub is comprised of a nickel-cobalt-iron alloy.

20. An x-ray tube comprising:

an envelope;

a cathode assembly, operatively positioned in the envelope;

an anode assembly including:

a rotor body assembly including a rotor and a stator, the stator being operatively positioned relative to the rotor body assembly; and a target, operatively positioned relative to the cathode assembly, operatively connected to a thin-walled tubular thermal barrier to form a target/bearing assembly, and a target/bearing assembly to the rotor body assembly connection structure, operatively positioned between the target/bearing assembly and the rotor body assembly, for operatively connecting the target/bearing assembly to the rotor body assembly, wherein the target/bearing assembly to the rotor body assembly connection structure further comprises, including shrink fit means, operatively positioned between the target/bearing assembly and the rotor body assembly, for operatively connecting the target/bearing assembly to the rotor body assembly wherein the target/bearing assembly to the rotor body assembly connection structure further comprises:

a shaft operatively positioned between the thin-walled tubular thermal barrier and operatively supported by opposing bearings mounted with a thin-walled tubular stem; and a rotor hub operatively positioned in the rotor body assembly, the rotor hub having an aperture configured to receive said shaft and form an interference/shrink fit engagement.

21. The x-ray tube of claim 20, wherein the materials selected for the rotor hub is selected to match a higher coefficient of thermal expansion of the rotor with a lower coefficient of thermal expansion of the shaft enabling operational loads to be carried by the shrink fit without any other means.

22. The x-ray tube of claim 20, wherein the rotor hub comprises a nickel-cobalt-iron alloy.

* * * * *